US006612585B2

(12) United States Patent
Grabe

(10) Patent No.: US 6,612,585 B2
(45) Date of Patent: Sep. 2, 2003

(54) ELASTOMERIC STRAND-SHAPED SEALING PROFILE

(75) Inventor: Werner Grabe, Dülmen (DE)

(73) Assignee: Däwyler AG Schweizerische Kabel - Gummi-und Kunststoffwerke, Schattdorf (DE)

( * ) Notice: Subject to any disclaimer, the term of this patent is extended or adjusted under 35 U.S.C. 154(b) by 0 days.

(21) Appl. No.: 10/269,485

(22) Filed: Oct. 11, 2002

(65) Prior Publication Data

US 2003/0085531 A1 May 8, 2003

(30) Foreign Application Priority Data

Oct. 11, 2001 (AU) ..... 1601/2001

(51) Int. Cl.[7] ..... F16L 17/03; F16J 15/02; E21D 11/38

(52) U.S. Cl. ..... 277/626; 277/644; 277/906; 277/921; 277/934; 405/152; 404/74

(58) Field of Search ..... 277/602–603, 277/605–609, 612, 615–616, 626, 628, 630, 637, 645, 644, 906, 921, 934; 405/135, 147, 152; 404/64, 65, 69, 74, 47, 50, 49, 68; 285/230

(56) References Cited

U.S. PATENT DOCUMENTS

| | | | | | |
|---|---|---|---|---|---|
| 2,156,681 | A | * | 5/1939 | Dewhirst et al. | 404/65 |
| 3,286,425 | A | * | 11/1966 | Brown | 52/396.06 |
| 4,195,850 | A | * | 4/1980 | Berger et al. | 277/650 |
| 4,199,158 | A | * | 4/1980 | de Munck | 277/648 |
| 4,762,441 | A | * | 8/1988 | Glang | 405/152 |
| 5,007,202 | A | * | 4/1991 | Guillon | 49/441 |
| 5,074,711 | A | * | 12/1991 | Glang et al. | 405/152 |
| 5,248,542 | A | * | 9/1993 | Hinzpeter et al. | 428/192 |
| 5,888,023 | A | * | 3/1999 | Grabe et al. | 405/152 |
| 6,267,536 | B1 | * | 7/2001 | Adachi et al. | 405/152 |
| 6,434,904 | B1 | * | 8/2002 | Gutschmidt et al. | 52/393 |

FOREIGN PATENT DOCUMENTS

| | | | | |
|---|---|---|---|---|
| DE | 3526063 | | 1/1987 | |
| DE | 3720919 | | 2/1988 | |
| DE | 4026076 | | 2/1991 | |
| DE | 4103009 | | 8/1991 | |
| DE | 0679510 | | 2/1992 | |
| DE | 2712655 | * | 11/1993 | F16J/15/10 |
| DE | 9603188 | | 8/1996 | |
| EP | 0306581 | | 3/1991 | |
| EP | 0522912 | | 1/1993 | |
| EP | 0574559 b | * | 7/1993 | E21D/11/38 |
| GB | 2251203 A | * | 7/1992 | B29C/39/10 |
| WO | 9416197 | | 7/1994 | |
| WO | 9424417 | | 10/1994 | |

* cited by examiner

*Primary Examiner*—Anthony Knight
*Assistant Examiner*—Vishal Patel
(74) *Attorney, Agent, or Firm*—Sidley Austin Brown & Wood, LLP

(57) ABSTRACT

An elastomeric strand-shaped sealing profile including at least one continuous transverse beam located in a region between the base and rear side surfaces of the profile and having two sidewise projecting cantilever arms, two sealing lips provided on the respective lateral side surfaces of the profile adjacent to the regions of the corners between the base surface and the respective lateral side surfaces and extending sidewise of the base body, two webs extending from corners formed by the rear side surface and respective lateral side surface and toward each other, and forming, together with a rear side surface-forming web, a triangular structure, and a further web extending from a tip of the triangular structure and toward the base surface and forming with the two webs a Y-shaped structure.

19 Claims, 1 Drawing Sheet

ELASTOMERIC STRAND-SHAPED SEALING PROFILE

BACKGROUND OF THE INVENTION

1. Field of the Invention

The present invention relates to an elastomeric, strand-shaped sealing profile for a tunnel segment having a receiving groove, the strand profile including a base surface, a rear side surface having a width smaller than a width of the base surface, and two opposite lateral side surfaces connecting the base surface with the rear side surface, with the base, rear side, and lateral side surfaces defining together a base body.

2. Description of the Prior Art

Sealing profiles for sealing gaps between tunnel segments are disclosed, e.g., in DE-35 26 063A1, DE-37 20 919 A1, DE-40 26 076 A1, DE-41 03 089 A1, DE-196 03 188 A1, CH-679 510 A5, EP-306 581 A1, and EP-522,912 A1. For sealing of the tunnel segments with circumferential receiving grooves, usually, four sealing profiles are secured in an associated sealing frame provided in the circumferential receiving groove in associated frame corners. The tunnel segments or tubings with sealing profiles arranged in their receiving grooves, are assembled to form a ring, with the separate rings forming together a complete tunnel tube described, e.g., in DE-196 03 188A1. The sealing profiles, which are located in opposite, facing each other, receiving grooves of two tunnel segments, have their rear surfaces lying on each other and are, and the profiles become compressed to a greater and lesser degree. The stresses are generated by corresponding elastic restoring forces, whereby the tunnel segments become sealed. Thereby, a long-lasting sealing against an increased water pressure in the soil or resulting from chasms is achieved.

As a rule, the water pressure, against which the seal is provided, lies in a range between 1 and 4 bar. In the English channel tunnel, this pressure lies in the range of 10 bar. Other tunnels are contemplated and planned in which the pressure, against which sealing should be provided, are substantially higher, e.g., up to 30 bar. Furthermore, reliable sealing should be insured even at a large gap width between the tunnel segments. Also, a gap can be formed as a result of deformation of an initially circular tunnel tube as a result of ovalization.

DE 35 26 063 A1 discloses a sealing profile with two rows of channels offset relative to each other. This sealing profile is incapable to withstand a high water pressure. The sealing profile, which is disclosed in DE-37 20 919 A1 is relatively flat and is not able to seal large gaps at high water pressures. The sealing profile, which is disclosed in DE-40 26 076 A1, becomes displaced upon application of a side water pressure, whereby the intended sealing effect of the expanded legs is cancelled. DE-41 03 089 A1 discloses a sealing profile with two, arranged one above the other, rows of channels, forming continuous vertical and sloping webs. Upon compression, without a sidewise offset of the opposite receiving grooves, this profile becomes deformed, causing pivoting and sidewise displacement of the tunnel segments relative to each other. CH-679 510 discloses a sealing profile with a single row of channels and which, because of its relative flatness, does not provide an adequate sealing against high water pressure at large gap widths. Common for all of the above-discussed sealing profiles is a loss of a sealing effect upon formation of subsequent gaps between the sealed segments even if these gaps are in a mm range. This is because the inner restoring force during expansion is noticeably smaller than during loading as a result of the hysteresis behavior of the elastomeric compression profile.

DE-196 03 188 A1 discloses a sealing profile provided, in its rear region, with an indentation in which a strip-shaped insert is received which is formed of a water-swellable material. Upon penetration of water, the volume of the material increases, providing additional sealing stresses.

Generally, it is known to use seals formed of water-swellable material in building construction, underground works, and other civil engineering works, in particular for sealing joints and for compensation of dimensional changes of the components. Such water-swellable materials are disclosed, e.g., among others, in WO 99/35208, the references cited therein, EP-0692 584 B1 and the references cited therein.

Also known are co-extruded sealing profiles having, in their rear region, a co-extruded water-swellable layer. These seals have a single row channel arrangement. One of such seals is disclosed in CH-679 510 A5.

Even these conventional sealing profiles, which include water-swellable material, are not capable to withstand high water pressures. Besides, e.g., the sealing profile of DE 196 03 188 A1, which includes a water-swellable insert, proved to be very expensive.

Accordingly, an object of the present invention is to provide an elastomeric strand-shaped sealing profile capable to withstand very high water pressures.

SUMMARY OF THE INVENTION

This and other objects of the present invention, which will become apparent hereinafter, are achieved by providing a sealing profile including at least one continuous transverse beam located in a region between the base surface and the rear side surface and projecting beyond a base body at the opposite lateral side surfaces, with projecting portions forming two projecting cantilever arms for engaging respective adjacent side surfaces of the receiving groove of the tunnel segment, two sealing lips provided on the base body on respective lateral side surfaces adjacent to regions of corners between the base surface and the respective lateral side surfaces, extending sidewise of the based body and continuously extending in a longitudinal direction of the sealing profile, and formed of a water-swellable material, and two webs extending from corners formed by the rear side surface and respective lateral side surfaces and toward each other, and forming, together with a rear side surface-forming web, a triangular structure, and a further web extending from a tip of the triangular structure and toward the base surface, the two webs and the further web forming together a Y-shaped structure.

The continuous transverse beam with the sidewise projecting, cantilever arms insures that upon a sidewise action of the water pressure, the sealing profile is supported against opposite side surfaces of the receiving groove of the tunnel segment and, therefore, is displaced sidewise by a very limited amount. Preferably, the cantilever arms are provided on a substantially trapezoidal body. With such reversed, with respect to the receiving groove, trapezoidal body, the sealing profile can be so formed that it can be completely inserted into the receiving groove, with the restoring forces remaining within acceptable limits. The maximum value of the restoring force should not be very high in order, e.g., not to chip off the receiving groove rims. The entire cross-sectional surface of the inventive sealing profile can be, e.g., in the range of 90% (±5%) of the cross-sectional surface of the receiving groove.

The expression "substantially trapezoidal" also refers to a body, having in cross-sectional view, lateral side surfaces inclined at different angles, e.g., above and below the sidewise projecting cantilever arms.

The water-side sealing lips, which are provided in corner regions between the base surface and respective lateral side surfaces, upon increase of the water pressure, are pressed against the side surfaces of the receiving groove, providing for an automatic sealing. Upon penetration of water, the sealing pressure is increased due to swelling of the sealing lip material, with increase of the volume of the sealing lips. The sealing lips would be further pressed against the side surfaces of the receiving groove, on one hand, and against the lateral side surfaces of the sealing profile, on the other hand, providing for an increased sealing effect. Preferably, the sealing lips are formed of a softer material than the base body, which provides for good adaptation of the sealing lips to the unevenness of a concrete surface.

The Y-shaped structure according to the present invention insures that the restoring forces are concentrated in the center of the receiving groove. According to a preferred embodiment of the present invention, at least two rows of channels are, distributed over the width of the sealing profile, with one row being provided in a region above the transverse beam and one row being provided below the transverse beam.

Advantageously, the base surface is formed as a closed bottom surface, without slots extending therefrom in the interior of the base body. Such a bottom surface insures a reliable mounting of the sealing profile in the groove, which contributes to the sealing stability.

According to a further preferred embodiment of the invention, a co-extruded insert formed of a water-swellable material is provided in the rear surface of the sealing profile. Upon penetration of water, in particular, as a result of a reduction of the compression sealing, the volume of the insert increases, providing for additional pressure action, whereby the loss of the compression force is compensated or even overcompensated.

The novel features of the present invention, which are considered as characteristic for the invention, are set forth in the appended claims. The invention itself, however, both as to its construction and its mode of operation, together with additional advantages and objects thereof, will be best understood from the following detailed description of a preferred embodiment, when read with reference to the accompanying drawings.

DETAILED DESCRIPTION OF THE PREFERRED EMBODIMENTS

Figure 1:
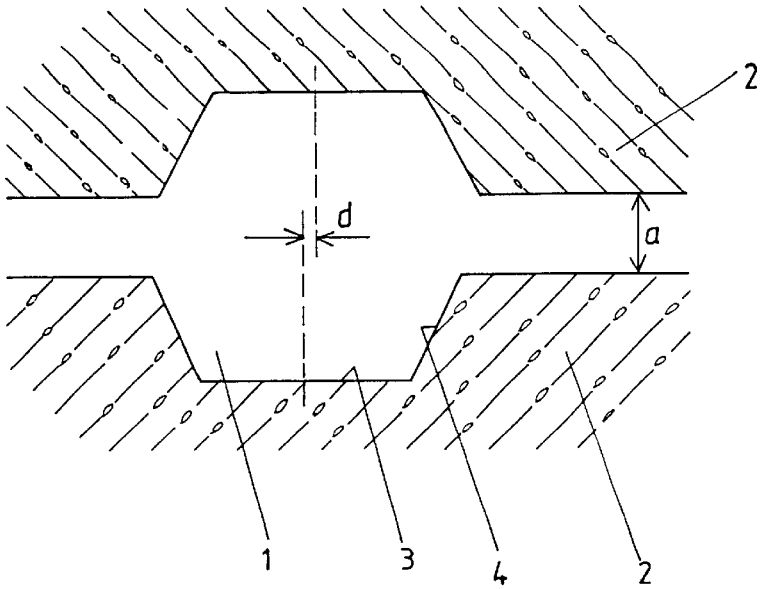
FIG. 1 a schematic cross-sectional view showing two opposite receiving grooves formed in facing each other side surfaces of two adjacent tunnel segments.

As discussed above, FIG. 1 shows schematically two adjacent segments 2 in the facing each other side surfaces of which, respectively, two opposite receiving grooves 1 are formed. The respective receiving grooves 1 extend circumferentially, with an inventive sealing profile being received in the two grooves. Each receiving groove, 1 has a bottom 3 and two side surfaces 4. There is formed between the two segments 2 a gap having a width a and which should be sealed by the sealing profile that is received in the opposite receiving grooves 1. The centers of the two opposite grooves 1 can be sidewise offset relative to each other by a distance d.

Figure 2:
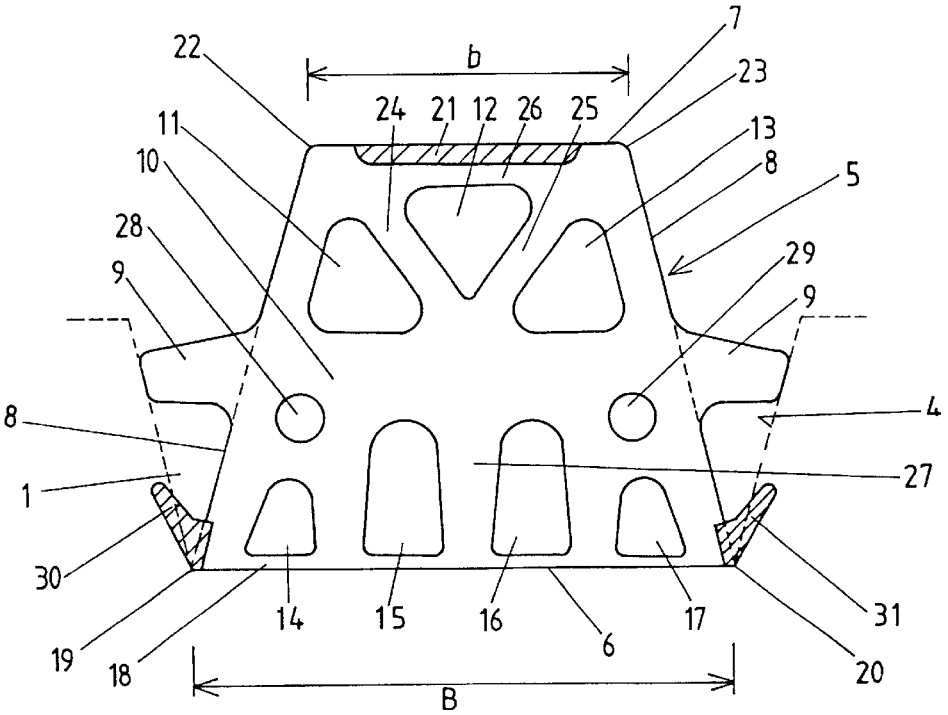
FIG. 2 a cross sectional view of a sealing profile according to the present invention.

The inventive sealing profile, which is shown in FIG. 2, is shown in its expanded condition, with the receiving grooves being shown with dash lines. The elastomeric, strand-shaped sealing profile according to the present invention has a base surface 6, a rear side surface 7 the width b of which is smaller than the width B of the profile base surface 6, and two side surfaces 8 connecting opposite edges of the base surface 6 with respective opposite edges of the rear side 7.

The sealing profile has, in cross-section, an isosceles trapezoidal base body 5 with the parallel sides of the base surface and the rear side surface 7 forming the sealing profile. A transverse beam 19 extends through the base body 5 and projects beyond opposite side surfaces 8. As a result, at the opposite lateral sides 8, cantilever arms 9 are formed, respectively. The cantilever arms 9 extend in the longitudinal direction continuously. However, interruption of the longitudinal extent of the cantilever arms 9 is allowed. The lateral side surfaces 8 are shown with dash lines in the regions of the cantilever arms 9. The cantilever arms 9 are formed integrally with the base body 5 and of the same material as the base body 5. The cantilever arms 9 are located in the regions of the lateral sides 8 which are spaced from both the base surface 6 and the rear side surface 7. The cantilever arms 9 are co-extruded, together with the base body 9. At that, it is possible to form the cantilever arms 9 of a material having a hardness different from the base body 5.

In cross-section, the cantilever arms 9 form an angle smaller than 30° with the base surface 6 of the sealing profile and, preferably, slightly inclined downward so that they extend at a substantially right angle with respect to the adjacent thereto side surface 4 of the receiving groove 1. The section of the transverse beam 10, which is located within the base body 5, extends substantially parallel to the base surface 6 of the sealing profile. The free ends of the projecting, beyond the base body 5, cantilever arms 9 engage respective side surfaces 4 of the groove 1.

In the sealing profile, above and below the transverse beam 10, over the width of the sealing profile, there are provided a plurality of channels. Above the transverse beam 10, there is provided a row of three channels 11, 12, 13 having a triangular shape. Below the transverse beam 10, there is provided a row of channels 14–17 located adjacent to the base surface 6. The channels 11–17 are closed by a wall 18, forming a row of closed slots. The upper points of these closed slots form a parabola-shaped arc, the maximum of which is located in the strand profile center and intersects the corners 19, 20 between the base surface 6 and respective adjacent lateral side surfaces.

Between the two side channels 14 and 17 and the transverse beam 10, there are provided two further channels 28, 29 having a circular cross-section.

Extending from the regions of opposite corners 22, 23, there are provided, between the rear side surface 7 and the lateral side surfaces 8, two, extending from a common point, webs 24, 25, which, together with a web 26 which forms the rear side surface 7, form a triangular structure. There is further provided a web 27 that extends from the tip of the triangular structure, which is formed by the webs 24, 25, 26, and toward the base surface. The web 27, forms, with the webs 24, 25, a Y-shaped structure. The node of this Y-shaped structure lies in the region of the transverse beam 10. Further, in the region of the node of the Y-shaped structure, the highest point of the parabolic arc, which connects the highest points of the slot-shaped channels 11–14, is located.

The trapezoidal shape of the base body 5, together with the Y-structure, which is formed by the webs 24, 25, 27, provide for concentration of restoring forces in the center of the groove 1 and in the groove corners located in the regions of the corners 19, 20.

In the rear side surface 7 of the sealing profile, which is formed by the web 26, there is provided a co-extrudable insert 21 that is formed of a water-swellable material. Preferably, the insert 21 is formed of a mixture of elastomers having hardness from 30 to 60 Shore A. The base body 5 and the cantilever arms 9 are advantageously formed of ethylene-propylene-terpolymer (EPDM) having a Shore A hardness from 65 to 95.

On the lateral side surfaces 8 of the sealing profile, there are provided sidewise projecting, sealing lips 30, 31 which continuously extend in the longitudinal direction of the sealing profile. The sealing lips 30, 31 are located adjacent to the corners 19, 20 between the base surface 6 and respective lateral side surfaces 8. In the embodiment shown in the drawing, the sealing lips 30, 31 are located immediately adjacent to the corners 19, 20, extending from the lateral side surfaces 8. In the expanded condition of the sealing profile, the sealing lips 30, 31 extend past the side surfaces 4 of the groove 1. Advantageously, the sealing lips 30, 31 are formed of a water-swellable material and are co-extruded with the sealing profile. Preferably, they are formed of a mixture of elastomers having a Shore A hardness in the range from 30 to 50.

The Shore A hardness corresponds practically to International rubber hardness degree according to ISO-standard 48.

The inventive sealing profile insures sealing against very high water pressures. The co-extruded construction, which includes the insert 21 and sealing lips 30, 31, further insures the reliability, in particular, with increase of the gap width between the adjacent tunnel segments.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments with the spirit and scope of the present invention as defined by the appended claims.

What is claimed is:

1. An elastomeric, strand-shaped sealing profile for a tunnel segment having a receiving groove, the sealing profile comprising:

a base surface, a rear side surface having a width smaller than a width of the base surface, and two opposite lateral side surfaces connecting the base surface with the rear side surface, the base, rear side, and lateral side surfaces defining together a base body;

at least one continuous transverse beam located in a region between the base surface and the rear side surface and projecting beyond a base body at the opposite lateral side surfaces, with projecting portions forming two projecting cantilever arms for engaging respective adjacent side surfaces of the receiving groove of the tunnel segment;

two sealing lips provided on the base body on respective lateral side surfaces adjacent to regions of corners between the base surface and the respective lateral side surfaces, extending sidewise of the base body and continuously extending in a longitudinal direction of the sealing profile, and formed of a water-swellable material; and two webs extending from corners formed by the rear side surface and respective lateral side surfaces and toward each other, and forming, together with a rear side surface-forming web, a triangular structure, and a further web extending from a tip of the triangular structure and toward the base surface, the two webs and the further web forming together a Y-shaped structure.

2. A sealing profile as set forth in claim 1, wherein the cantilever arms, in cross-section, form an angle of less than 30° with the base surface.

3. A sealing profile as set forth in claim 2, wherein the cantilever arms are so formed that they extend, in a mounted position of the sealing profile, substantially at a right angle to respective side surfaces of the receiving groove of the tunnel segment.

4. A sealing profile as set forth in claim 1, wherein the at least one transverse beam extends continuously in longitudinal direction of the sealing profile.

5. A sealing profile as set forth in claim 4, wherein the base body extends parallel to the base surface.

6. A sealing profile as set forth in claim 1, wherein the cantilever arms continuously extend in a longitudinal direction of the sealing profile.

7. A sealing profile as set forth in claim 1, wherein the base body has a substantially trapezoidal shape.

8. A sealing profile as set forth in claim 1, wherein the base body and the cantilever arms are formed of a same material.

9. A sealing profile as set forth in claim 1, wherein the base surface is formed as a bottom surface.

10. A sealing profile as set forth in claim 9, wherein a plurality of spaced from each other channels are formed in a region of the sealing profile adjoining the base surface and which are formed as slots closed by a wall at sides thereof adjacent to the base surface, with upper points of the slots lying on an imaginable parabolic arc maximum of which lies in the center of the sealing profile and which extends through the regions of the corners formed between the base surface and the respective lateral side surfaces.

11. A sealing profile as set forth in claim 4, comprising at least two rows of channels distributed over the width of the sealing profile, with one row being provided in a region above the transverse beam and one row being provided below the transverse beam.

12. A sealing profile as set forth in claim 1, further comprising a co-extruded insert provided in the rear side surface-forming web and formed of a water-swellable material.

13. A sealing profile as set forth in claim 1, wherein the sealing lips are located immediately adjacent to the corners between the base surface and the respective lateral side surfaces.

14. A sealing profile as set forth in claim 1, wherein the sealing lips are formed of a softer material than the base body and are co-extruded with the base body.

15. A sealing profile as set forth in claim 14, wherein the sealing lips have a Shore A hardness between 30 and 50.

16. A sealing profile as set forth in claim 1, wherein the base body has a Shore A hardness in a range between 65 and 95.

17. A sealing profile as set forth in claim 16, wherein the base body is formed of ethylene-propylene-terpopolymer.

18. A sealing profile as set forth in claim 12, wherein the insert is formed of a mixture of elastomers having a Shore A hardness between 30 and 65.

19. A sealing profile as set forth in claim 1, wherein the total cross-sectional surface of the sealing profile corresponds to 85–95% of a cross-sectional surface of the receiving groove of the tunnel section.

* * * * *